US008251125B2

(12) United States Patent
Yamada et al.

(10) Patent No.: US 8,251,125 B2
(45) Date of Patent: Aug. 28, 2012

(54) METAL MOLD APPARATUS

(75) Inventors: Kenichi Yamada, Shizuoka (JP); Taro Nozaki, Shizuoka (JP)

(73) Assignee: Showa Corporation, Saitama (JP)

( * ) Notice: Subject to any disclaimer, the term of this patent is extended or adjusted under 35 U.S.C. 154(b) by 0 days.

(21) Appl. No.: 13/051,739

(22) Filed: Mar. 18, 2011

(65) Prior Publication Data

US 2012/0048500 A1 Mar. 1, 2012

(30) Foreign Application Priority Data

Aug. 27, 2010 (JP) ..... 2010-191234

(51) Int. Cl.
*B22D 17/22* (2006.01)
*B22D 29/00* (2006.01)
*A23G 9/00* (2006.01)

(52) U.S. Cl. ..... 164/347; 164/131; 249/68

(58) Field of Classification Search ..... 164/344–347, 164/131–132; 425/444, 556; 249/66.1, 67, 249/68; 264/334
See application file for complete search history.

(56) References Cited

FOREIGN PATENT DOCUMENTS

JP 2009-56503 3/2009

*Primary Examiner* — Jessica L Ward
*Assistant Examiner* — Steven Ha
(74) *Attorney, Agent, or Firm* — Keith H. Orum

(57) ABSTRACT

In a state in which an insert is fitted to an inner portion of a main mold, a hole passing through from an outer portion of the main mold to a cavity of the insert is provided in the main mold to the insert. An extrusion pin bush is inserted into the hole from a side of an opening portion facing the outer portion of the main mold in the hole. A stopper, which is loosely inserted into an outer periphery of a base end side protruding to the outer portion of the main mold from an inner diameter portion of the extrusion pin bush of the extrusion pin, is attached by screw to a thread portion provided in the opening portion facing the outer portion of the main mold. The extrusion pin bush abuts on a locking portion provided on the side of the opening portion facing the outer portion of the main mold in the hole by the stopper.

16 Claims, 5 Drawing Sheets

METAL MOLD APPARATUS

BACKGROUND OF THE INVENTION

1. Field of the Invention

The invention relates to a metal mold apparatus which is used for forming a formed product having a desired shape and solidifying within a cavity, by filling a molten forming material such as a metal material, a resin material or the like in the cavity. The metal mold apparatus in which the cavity is formed by and comprises an insert fitted to an inner portion of a main mold.

2. Description of the Related Art

A metal mold apparatus of a related art as shown in Japanese Patent Application Laid-Open No. 2009-56503 has a fixed main mold 1 and a movable main mold 2, and has an insert 1A fitted to an inner portion of the fixed main mold 1, and an insert 2A fitted to an inner portion of the movable main mold 2, as shown in FIG. 5. A cavity 3 having a predetermined shape is formed in the inner portions by moving so as to close the movable main mold 2 with respect to the fixed main mold 1, and by mold closing the insert 1A of the fixed main mold 1 and the insert 2A of the movable main mold 2. A formed product P solidifying within the cavity 3 and having a desired shape is formed by filling a molten forming material in the cavity 3.

The metal mold apparatus is provided with a hole 4 in the insert 2A of the movable main mold 2, and receives a bush 5 for an extrusion pin into the hole 4. The hole 4 is constructed by a larger diameter hole portion 4A on an opposite side to a cavity forming surface 3A, and a smaller diameter hole portion 4B on a side of the cavity forming surface 3A. A larger diameter portion 5A of the extrusion pin bush 5 is inserted into the larger diameter hole portion 4A from a back face side of the insert 2A (an opposed side to the cavity forming surface 3A), and a smaller diameter portion 5B is inserted into the smaller diameter hole portion 4B. When the insert 2A to which the extrusion pin bush 5 is inserted is fitted to the inner portion of the movable main mold 2, the extrusion pin bush 5 is sandwiched particularly regarding its larger diameter portion 5A by the inner surface of the movable main mold 2 and the larger diameter hole portion 4A of the insert 2A so as to be solidified.

Further, in the metal mold apparatus, the movable main mold 2 is provided with a hole 6 which passes through coaxially and with the same inner diameter from an outer portion of the movable main mold 2 toward an inner diameter portion 5C of the extrusion pin bush 5, in a state in which the insert 2A inserting the extrusion pin bush 5 thereto is fitted to the inner portion of the movable main mold 2. Further, an extrusion pin 7 is inserted into the inner diameter portion 5C of the extrusion pin bush 5 from the outer portion of the movable main mold 2 via the hole 6 of the movable main mold 2. Each of insertion end surfaces of the extrusion pin bush 5 and the extrusion pin 7 to the smaller diameter hole portion 4B and the inner diameter portion 5C is arranged on the same surface as the cavity forming surface 3A of the insert 2A. An extrusion plate 8 is provided on a base end portion which protrudes to the outer portion of the movable main mold 2 in the extrusion pin 7.

Accordingly, the mold is opened by moving so as to open the movable main mold 2 from the fixed main mold 1, at a time when the formed product P is formed within the cavity 3 of the fixed main mold 1 and the movable main mold 2. At this time, the formed product P is released from the insert 1A of the fixed main mold 1, and is attached to the insert 2A of the movable main mold 2. Thereafter, the formed product P is released from the insert 2A of the movable main mold 2 so as to be detached, by protruding the extrusion pin 7 into the cavity 3 of the insert 2A by using the extrusion plate 8.

In the conventional metal mold apparatus, there is a case that actuations of the extrusion pin 7 and the extrusion pin bush 5 are deteriorated by repeatedly using the extrusion pin 7, and the extrusion pin 7 is broken. At this time, since the extrusion pin 7 and the extrusion pin bush 5 are gnawed, the extrusion pin 7 can not be drawn out of a side of the extrusion plate 8. It is necessary to draw out the extrusion pin 7 from the insert 2A of the movable main mold 2 together with the extrusion pin bush 5 in accordance with the following procedure.

(1) bring down the movable main mold 2 from a casting apparatus.

(2) detach the extrusion plate 8.

(3) detach the insert 2A from the movable main mold 2.

(4) detach the extrusion pin bush 5 and the broken extrusion pin 7 from a back face side of the insert 2A (an opposed side to the cavity forming surface 3A).

(5) insert a new extrusion pin bush 5 to the hole 4 of the insert 2A from the back face side of the insert 2A.

(6) reassemble the insert 2A to the movable main mold 2.

(7) insert a new extrusion pin 7 to the hole 6 of the movable main mold 2 and the inner diameter portion 5C of the extrusion pin bush 5 from the outer portion of the movable main mold 2. Attach the extrusion plate 8 to the extrusion pin 7.

(8) return the movable main mold 2 to the casting apparatus.

In the related art, it is necessary to detach the insert 2A from the movable main mold 2 and thereafter reassemble (detach and attach), for replacing the broken extrusion pin 7. Man hours for replacing is increased. Particularly, the movable main mold 2 and the insert 2A have a tight fit, and are hard to be detached and attached.

SUMMARY OF THE INVENTION

An object of the invention is to make it possible to replace a broken extrusion pin and an extrusion pin bush without detaching an insert from a main mold, in a metal mold apparatus.

In a first embodiment of the invention, there is provided a metal mold apparatus in which a cavity is formed by an insert fitted to an inner portion of a main mold. A hole passing through from an outer portion of the main mold to the cavity of the insert is provided in the main mold to the insert, in a state in which the insert is fitted to the inner portion of the main mold, an extrusion pin bush is inserted into the hole from a side of an opening portion facing an outer portion of the main mold in the hole, a part of a leading end side of the extrusion pin is inserted into an inner diameter portion of the extrusion pin bush, and respective insertion end surfaces of the extrusion pin bush and the extrusion pin are arranged on a same surface as a cavity forming surface of the insert, an outer periphery of a base end side portion protruding to the outer portion of the main mold from the inner diameter portion of the extrusion pin bush of the extrusion pin, is loosely inserted into a stopper, said stopper being attached by screw to a thread portion provided in the opening portion facing the outer portion of the main mold, and the extrusion pin bush abuts on a locking portion provided on the side of the opening portion facing the outer portion of the main mold in the hole by the stopper.

In a second embodiment of the invention, there is provided the metal mold apparatus according to the first embodiment, wherein the hole is constructed by a larger diameter hole portion which is provided on a side of the opening portion of the main mold, and a smaller diameter portion which is provided on an opposed opening portion from the larger diameter hole portion of the main mold and in the insert. The extrusion pin bush is constructed by a larger diameter portion which is inserted into the larger diameter hole portion of the hole, and a smaller diameter portion which is inserted into the smaller hole portion of the hole. A step surface on a boundary of the larger diameter portion and the smaller diameter portion of the extrusion pin bush abuts on a step-like locking portion on a boundary of the larger diameter hole portion and the smaller diameter hole portion of the hole.

In a third embodiment of the invention, there is provided the metal mold apparatus according to the first or second embodiments, wherein the stopper has a head portion which protrudes to an outer portion from the opening portion facing the outer portion of the main mold, and a tool engagement portion is provided in an outer periphery of the head portion.

In a fourth embodiment of the invention, there is provided the metal mold apparatus according to any one of first to third embodiments, wherein an extrusion plate is detachably provided on a base end portion protruding to an outer portion from the main mold in the extrusion pin.

In a fifth embodiment of the invention, there is provided the metal mold apparatus according to any one of first to fourth embodiments, wherein the metal mold apparatus has a fixed main mold and a movable main mold, and the movable main mold is provided with the extrusion pin bush and the extrusion pin.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings:

FIGS. 4A and 4B show a substantial part of FIG. 1, in which FIG. 4A is a cross sectional view, and FIG. 4B is a view as seen from an arrow along a line B-B in FIG. 4A.

DESCRIPTION OF THE PREFERRED EMBODIMENTS

Figure 1:
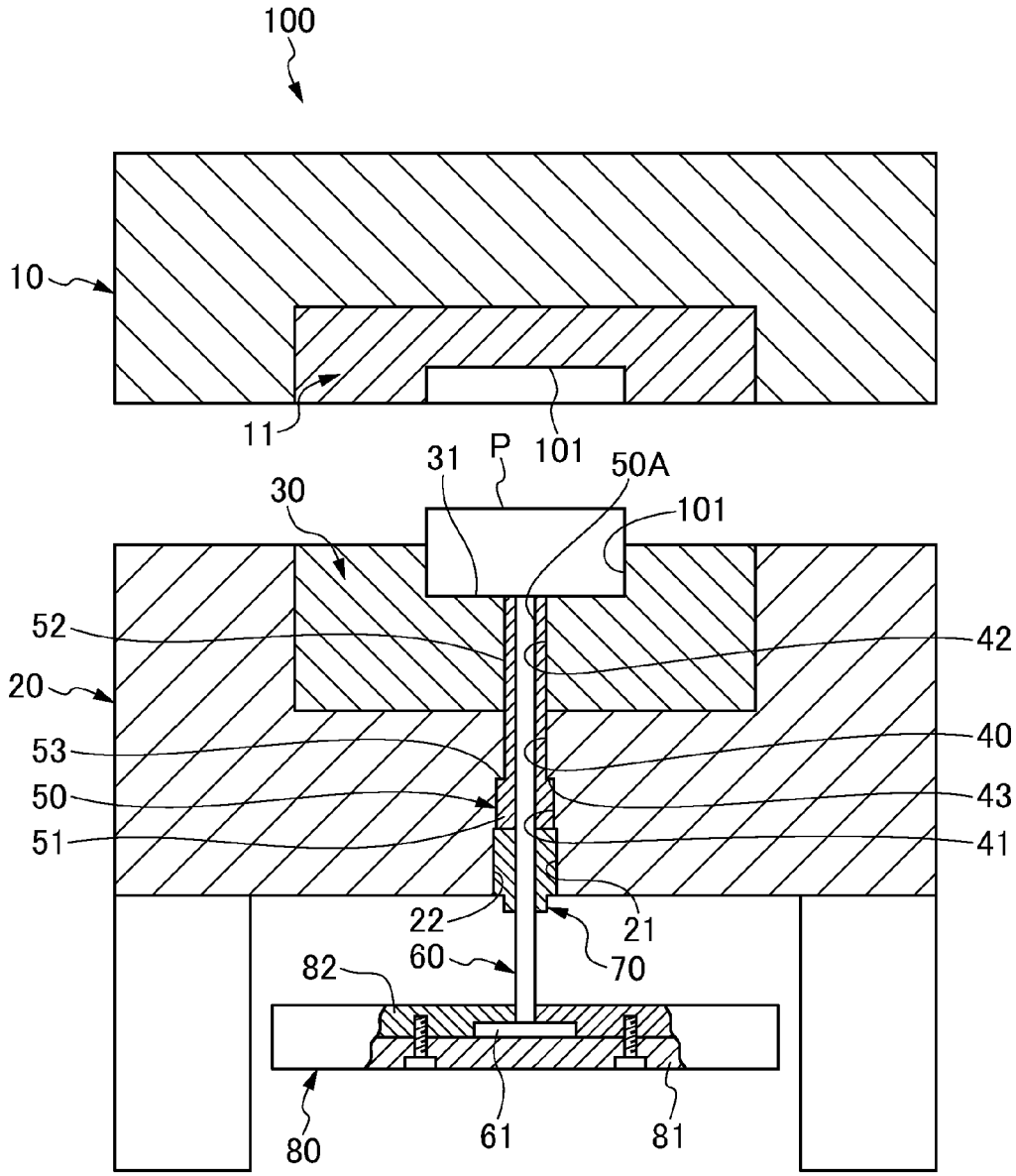
FIG. 1 is a cross sectional view showing a mold open state of a metal mold apparatus.

A metal mold apparatus 100 shown in FIG. 1 has a fixed main mold 10 and a movable main mold 20 which are attached to a casting apparatus (not shown), and has an insert 11 fitted to an inner portion of the fixed main mold 10, and an insert 30 fitted to an inner portion of the movable main mold 20. A cavity 101 having a predetermined shape is formed in inner portions thereof by moving so as to close the movable main mold 20 with respect to the fixed main mold 10, and by mold closing the insert 11 of the fixed main mold 10 and the insert 30 of the movable main mold 20. A formed product P which is solidified within the cavity 101 and has a desired shape is formed by filling a molten forming material in the cavity 101.

In the metal mold apparatus 100, the movable main mold 20 to the insert 30 is provided with a hole 40 which passes through from an outer portion of the movable main mold 20 (an outer portion on an opposed side to the inner portion to which the insert 30 of the movable main mold 20 is fitted) to the cavity 101 of the insert 30, in a state in which the insert 30 is fitted to the inner portion of the movable main mold 20.

In the metal mold apparatus 100, an extrusion pin bush 50 is inserted into the hole 40 from a side of an opening portion facing the outer portion of the movable main mold 20 in the hole 40. A part in a leading end side of an extrusion pin 60 is inserted into an inner diameter portion 50A of the extrusion pin bush 50, and respective insertion end surfaces to the hole 40 and the inner diameter portion 50A in the extrusion pin bush 50 and the extrusion pin 60 are arranged on the same surface as the cavity forming surface 31 of the insert 30.

In the metal mold apparatus 100, a hollow rod-like stopper 70, which is loosely inserted into an outer periphery of a base end side protruding to an outer portion of the movable main mold 20 from the inner diameter portion 50A of the extrusion pin bush 50 of the extrusion pin 60, is attached by screw to a female thread portion 22 provided in an opening portion 21 facing an outer portion of the movable main mold 20. The extrusion pin bush 50 is pressed with respect to a locking portion 43 provided on a side of the opening portion 21 facing the outer portion of the movable main mold 20 in the hole 40 by the stopper 70 so as to abut.

Figure 4A:
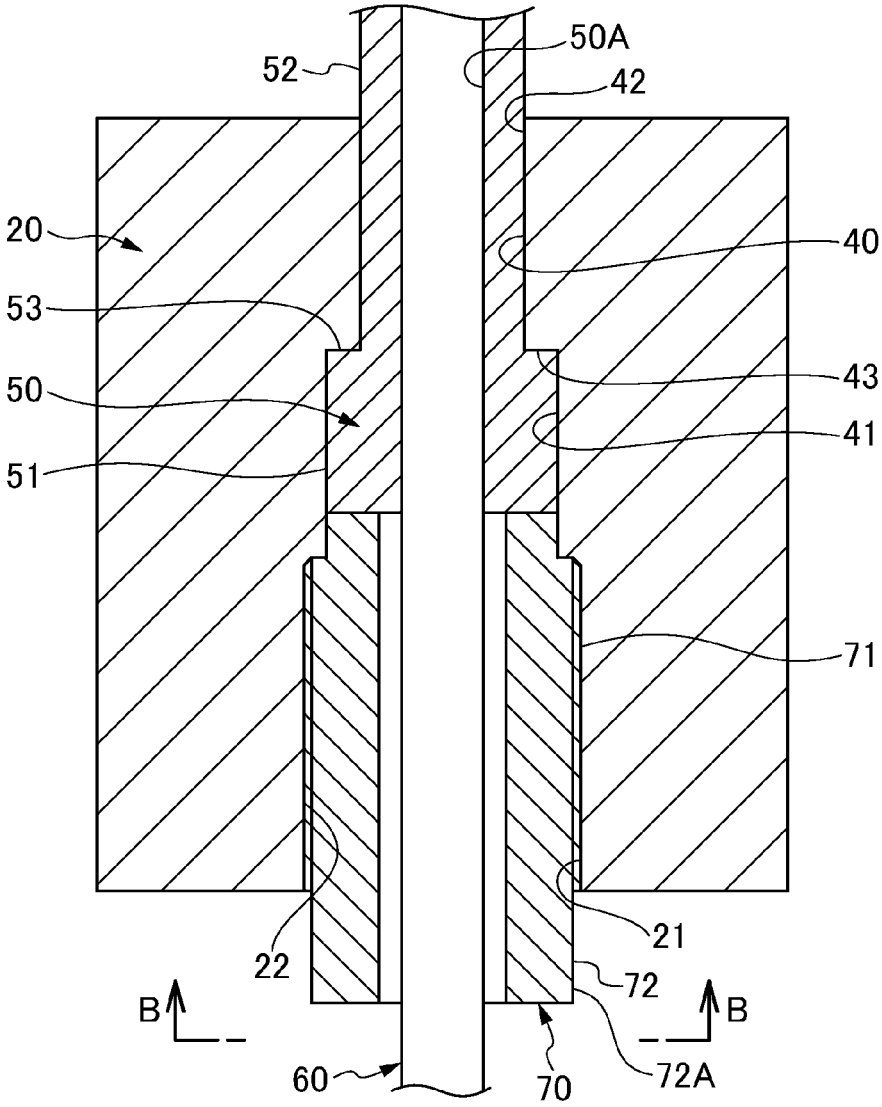
Figure 4B:
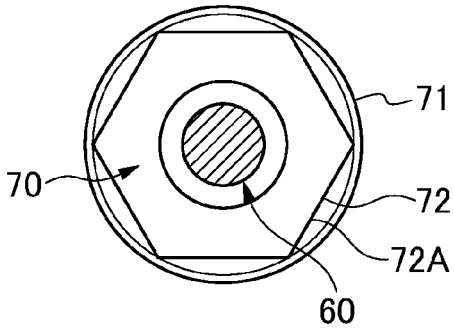
Figure 5:
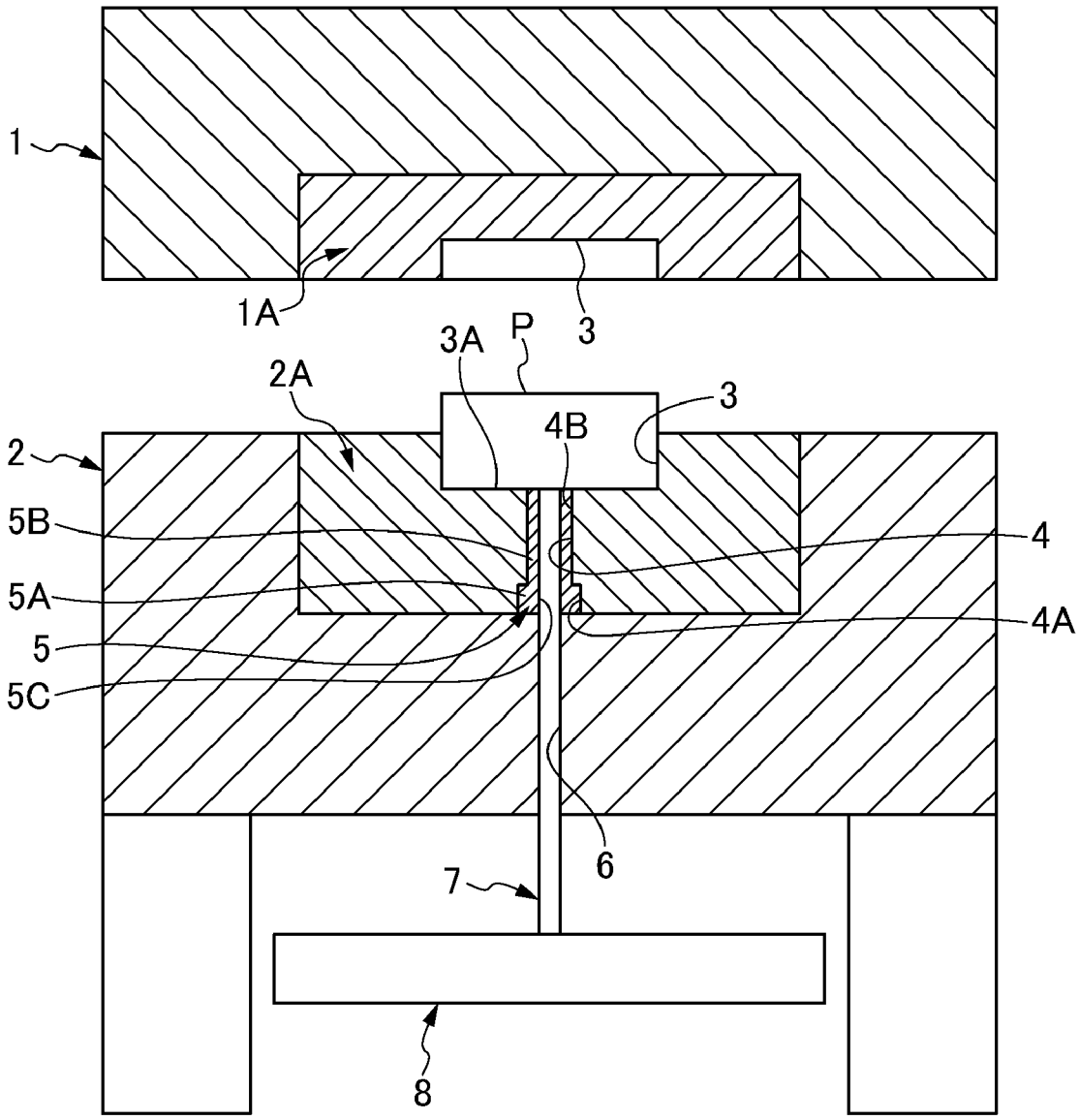
FIG. 5 is a cross sectional view showing a related art.

As shown in FIGS. 4A and 4B, the stopper 70 is formed as a hollow rod shape. It is constructed by a male thread portion 71 which is attached by screw to the female thread portion 22 of the movable main mold 20, and a head portion 72 protruding to an outer portion from the opening portion 21 facing the outer portion of the movable main mold 20 in a state in which the male thread portion 71 is attached by screw to the female thread portion 22. It is provided with a tool engagement portion 72A, for example, formed as a hexagonal shape, in an outer periphery of the head portion 72. The stopper 70 is screw moved by a tool engaging with the tool engagement portion 72A in an outer periphery of the head portion 72, and is attached to and detached from the female thread portion 22.

Specifically, as shown in FIGS. 4A and 4B, the hole 40 provided in the movable main mold 20 to the insert 30 is constructed by a larger diameter hole portion 41 which is provided on a side of the opening portion 21 of the movable main mold 20, and a smaller diameter hole portion 42 which is provided on an opposed side to the opening portion 21 from the larger diameter hole portion 41 of the movable main mold 20 and in the insert 30. The extrusion pin bush 50 is constructed by a larger diameter portion 51 which is inserted into the larger diameter hole portion of the hole 40, and a smaller diameter portion 52 which is inserted into the smaller diameter hole portion 42 of the hole 40. A step surface 53 on the boundary of the larger diameter portion 51 and the smaller diameter portion 52 of the extrusion pin bush 50 abuts on the step-like locking portion 43 on the boundary of the larger diameter hole portion 41 and the smaller diameter hole portion 42 of the hole 40.

In the metal mold apparatus 100, an extrusion plate 80 is detachably provided on a base end portion protruding to the outer portion from the movable main mold 20 of the extrusion pin 60. The extrusion plate 80 pinches a swelling portion 61 provided on a base end portion of the extrusion pin 60 by fixing by bolt a plate 81 attached to one side of the swelling portion 61 and an attachment plate 82 fastened to right and left of the other side.

In this connection, in the metal mold apparatus 100, the extrusion pin 60 is replaced in accordance with the following procedure, at a time when the actuations of the extrusion pin 60 and the extrusion pin bush 50 are deteriorated by repeatedly using the extrusion pin 60, and the extrusion pin 60 is broken.

(1) bring down the movable main mold 20 from the casting apparatus.

Figure 2A:
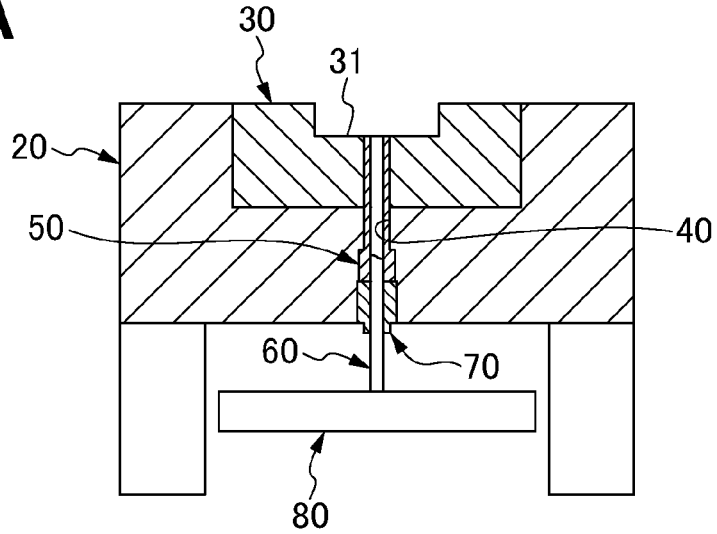
FIGS. 2A to 2C are schematic views showing a detaching process of a broken extrusion pin.
Figure 2B:
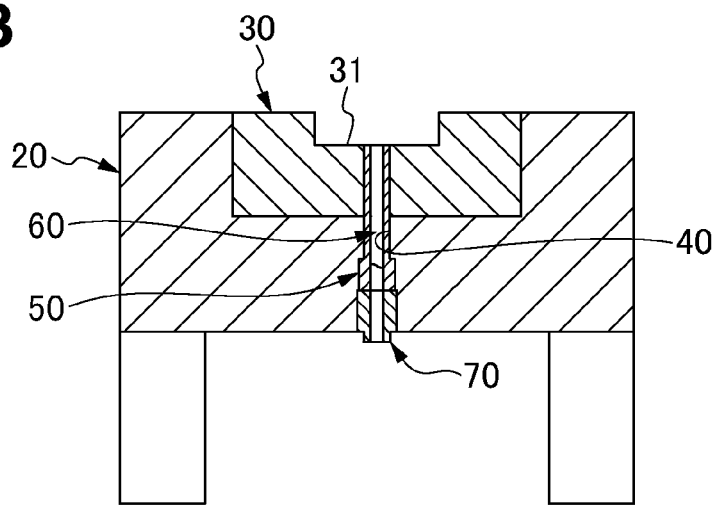

(2) detach the extrusion plate 80 (FIGS. 2A and 2B).

Figure 2C:
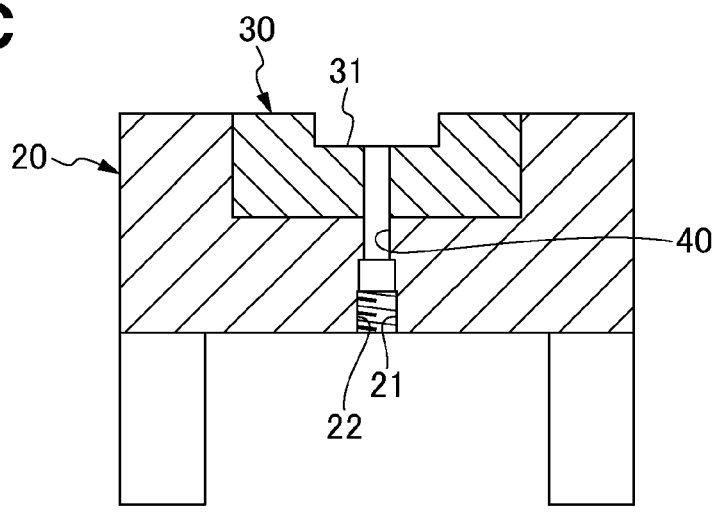

(3) detach the stopper 70 from the female thread portion 22 of the opening portion 21 of the movable main mold 20. Further, detach the extrusion pin bush 50 and the broken extrusion pin 60 from the hole 40 of the movable main mold 20 and the insert 30 by extruding the extrusion pin bush 50 and the broken extrusion pin 60 from the side of the cavity forming surface 31 of the insert 30 (FIG. 2C).

Figure 3A:
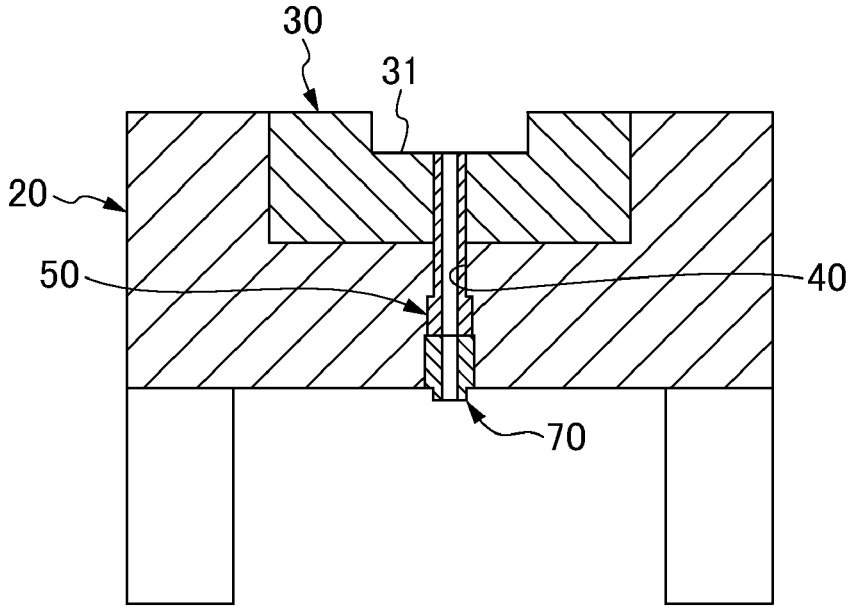
FIGS. 3A and 3B are schematic views showing an inserting process of a new extrusion pin.

(4) insert a new extrusion pin bush 50 to the hole 40 of the movable main mold 20 and the insert 30 from the opening portion 21 of the movable main mold 20. Further, attach by screw the stopper 70 to the female thread portion 22 of the opening portion 21 in the movable main mold 20, and abut the step surface 53 on the boundary of the larger diameter portion 51 and the smaller diameter portion 52 of the extrusion pin bush 50 to the step-like locking portion 43 of the larger diameter hole portion 41 and the smaller diameter hole portion 42 of the hole 40 so as to fix (FIG. 3A).

Figure 3B:
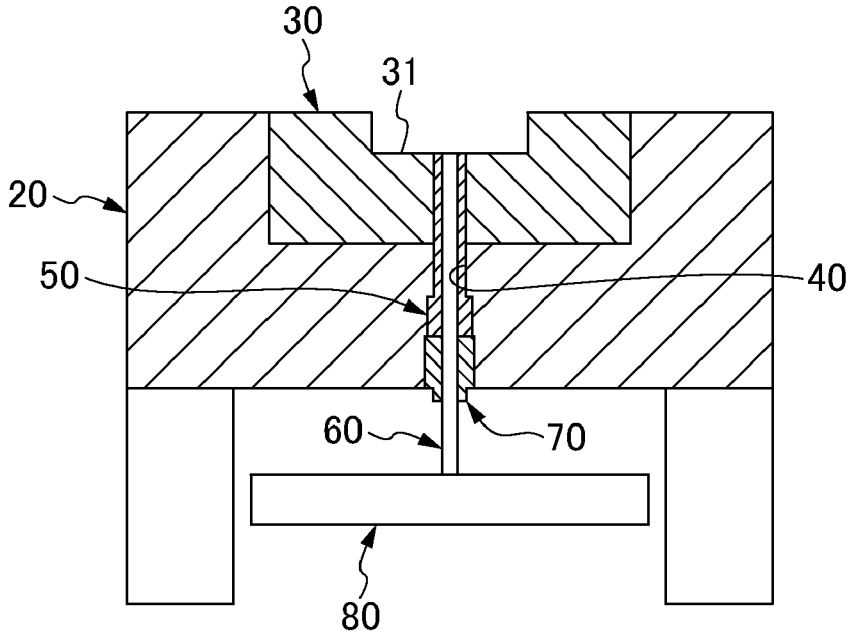

(5) insert a new extrusion pin 60 to which the extrusion plate 80 is attached, to the hollow portion of the stopper 70 to the inner diameter portion 50A of the extrusion pin bush 50 (FIG. 3B).

(6) return the movable main mold 20 to the casting apparatus.

In accordance with the embodiment, the following operations and effects can be achieved.

(a) The stopper 70 abutting the extrusion pin bush 50 to the movable main mold 20 can be attached to and detached from the female thread portion 22 provided in the opening portion 21 facing the outer portion, from the outer portion of the movable main mold 20. Accordingly, the broken extrusion pin 60 can be detached from the opening portion 21 facing the outer portion together with the extrusion pin bush 50, by detaching the stopper 70. Further, the new extrusion pin 60 and the extrusion pin bush 50 can be inserted into the hole 40 provided in the movable main mold 20 and the insert 30 from the opening portion 21 facing the outer portion, and the inserted extrusion pin bush 50 can be reabutted by the stopper 70. Accordingly, it is possible to replace the broken extrusion pin 60 and the extrusion pin bush 50 without detaching the insert 30 from the movable main mold 20. It is possible to simply replace the broken extrusion pin 60 so as to reduce man hours for replacement.

(b) The hole 40 provided in the movable main mold 20 to the insert 30 is constructed by the larger diameter hole portion 41 which is provided on the side of the opening portion 21 of the movable main mold 20, and the smaller diameter hole portion 42 which is provided on the side of the opposed opening portion 21 from the large diameter hole portion 41 of the movable main mold 20, and the insert 30. The extrusion pin bush 50 is constructed by the larger diameter portion 51 which is inserted into the larger diameter hole portion 41 of the hole 40, and the smaller diameter portion 52 which is inserted into the smaller diameter hole portion 42 of the hole 40, and the step surface 53 on the boundary of the larger diameter portion 51. The smaller diameter portion 52 of the extrusion pin bush 50 abuts on the step-like locking portion 43 on the boundary of the larger diameter hole portion 41 and the smaller diameter hole portion 42 of the hole 40. Accordingly, it is possible to insert the extrusion pin bush 50 to the hole 40 provided in the movable main mold 20 to the insert 30, and it is possible to securely abut the extrusion pin bush 50 on the locking portion provided in the hole 40 by the stopper 70.

(c) Since the stopper 70 has the head portion 72 protruding to the outer portion from the opening portion 21 facing the outer portion of the movable main mold 20, and the tool engagement portion 72A is provided in the outer periphery of the head portion 72, it is possible to immediately and securely move by screw the stopper 70 by the tool. In the case where the tool engagement portion 72A is provided in the inner periphery of the stopper 70, the extrusion pin 60 which is difficult to be removed forms an obstacle at a time when the extrusion pin 60 is broken in the inner portion of the stopper 70, during which time the tool can not be used.

(d) The extrusion plate 80 can be attached to and detached from the base end portion protruding to the outer portion from the movable main mold 20 of the extrusion pin 60.

(e) The metal mold apparatus 100 has the fixed main mold 10 and the movable main mold 20, and the movable main mold 20 is provided with the extrusion pin bush 50 and the extrusion pin 60.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

In accordance with the invention, in the metal mold apparatus in which the cavity is formed by the insert fitted to the inner portion of the main mold, in the state in which the insert is fitted to the inner portion of the main mold, the hole passing through from the outer portion of the main mold to the cavity of the insert is provided in the main mold to the insert. The extrusion pin bush is inserted into the hole from the side of the opening portion facing the outer portion of the main mold in the hole. A part of the leading end side of the extrusion pin is inserted into the inner diameter portion of the extrusion pin bush. The insertion end surfaces of the extrusion pin bush and the extrusion pin are arranged on the same surface as the cavity forming surface of the insert. The stopper, which is loosely inserted into the outer periphery of the base end side protruding to the outer portion of the main mold from the inner diameter portion of the extrusion pin bush of the extrusion pin, is attached by screw to the thread portion provided in the opening portion facing the outer portion of the main mold. The extrusion pin bush abuts with respect to the locking portion provided on the side of the opening portion facing the outer portion of the main mold in the hole by the stopper. Accordingly, in the metal mold apparatus, it is possible to replace the broken extrusion pin and the extrusion pin bush without detaching the insert from the main mold.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended claims.

What is claimed is:

1. A metal mold apparatus in which a cavity is formed by an insert fitted to an inner portion of a main mold, comprising;

a hole passing through from an outer portion of the main mold to the cavity of the insert, provided in the main mold to the insert, in a state in which the insert is fitted to the inner portion of the main mold, an extrusion pin bush inserted into the hole from a side of an opening portion facing an outer portion of the main mold in the hole, a part of a leading end side of the extrusion pin is inserted into an inner diameter portion of the extrusion pin bush, and respective insertion end surfaces of the extrusion pin bush and the extrusion pin arranged on a same surface as a cavity forming surface of the insert, a stopper inserted into an outer periphery of a base end side portion and having a head portion protruding out of the stopper, said stopper attached by screw to a thread portion provided in the opening portion facing the outer portion of the main mold, and the extrusion pin bush pressed with respect to a locking portion provided on a side of the opening portion facing the outer portion of the movable main mold in the hole by the stopper.

2. The metal mold apparatus according to claim 1, wherein the hole has a large diameter hole portion provided on a side of the opening portion of the main mold, and a small diameter portion provided on an opposed opening portion from the larger diameter hole portion of the main mold and in the insert, wherein the extrusion pin bush has a large diameter portion inserted into the larger diameter hole portion of the hole, and a smaller diameter portion inserted into the smaller hole portion of the hole, and a step surface on a boundary of the larger diameter portion and the small diameter portion of the extrusion pin bush abuts the locking portion on a boundary of the large diameter hole portion and the smaller diameter hole portion of the hole.

3. The metal mold apparatus according to claim 1, wherein the stopper has a head portion which protrudes to an outer portion from the opening portion facing the outer portion of the main mold, and a tool engagement portion is provided in an outer periphery of the head portion.

4. The metal mold apparatus according to claim 2, wherein the stopper has a head portion which protrudes to an outer portion from the opening portion facing the outer portion of the main mold, and a tool engagement portion is provided in an outer periphery of the head portion.

5. The metal mold apparatus according to claim 1, wherein an extrusion plate is detachably provided on a base end portion protruding to an outer portion from the main mold in the extrusion pin.

6. The metal mold apparatus according to claim 2, wherein an extrusion plate is detachably provided on a base end portion protruding to an outer portion from the main mold in the extrusion pin.

7. The metal mold apparatus according to claim 3, wherein an extrusion plate is detachably provided on a base end portion protruding to the outer portion from the main mold in the extrusion pin.

8. The metal mold apparatus according to claim 4, wherein an extrusion plate is detachably provided on a base end portion protruding to the outer portion from the main mold in the extrusion pin.

9. The metal mold apparatus according to claim 1, wherein the metal mold apparatus has a fixed main mold and a movable main mold, and the movable main mold is provided with the extrusion pin bush and the extrusion pin.

10. The metal mold apparatus according to claim 2, wherein the metal mold apparatus has a fixed main mold and a movable main mold, and the movable main mold is provided with the extrusion pin bush and the extrusion pin.

11. The metal mold apparatus according to claim 3, wherein the metal mold apparatus has a fixed main mold and a movable main mold, and the movable main mold is provided with the extrusion pin bush and the extrusion pin.

12. The metal mold apparatus according to claim 4, wherein the metal mold apparatus has a fixed main mold and a movable main mold, and the movable main mold is provided with the extrusion pin bush and the extrusion pin.

13. The metal mold apparatus according to claim 5, wherein the metal mold apparatus has a fixed main mold and a movable main mold, and the movable main mold is provided with the extrusion pin bush and the extrusion pin.

14. The metal mold apparatus according to claim 6, wherein the metal mold apparatus has a fixed main mold and a movable main mold, and the movable main mold is provided with the extrusion pin bush and the extrusion pin.

15. The metal mold apparatus according to claim 7, wherein the metal mold apparatus has a fixed main mold and a movable main mold, and the movable main mold is provided with the extrusion pin bush and the extrusion pin.

16. The metal mold apparatus according to claim 8, wherein the metal mold apparatus has a fixed main mold and a movable main mold, and the movable main mold is provided with the extrusion pin bush and the extrusion pin.

* * * * *